US006659838B1

(12) United States Patent
Anderson

(10) Patent No.: US 6,659,838 B1
(45) Date of Patent: Dec. 9, 2003

(54) RIGID HELIUM BALLOONS

(76) Inventor: Lloyd R. Anderson, 106 Diddle Dr., Hendersonville, TN (US) 37075

( * ) Notice: Subject to any disclaimer, the term of this patent is extended or adjusted under 35 U.S.C. 154(b) by 0 days.

(21) Appl. No.: 10/366,387

(22) Filed: Feb. 14, 2003

(51) Int. Cl.[7] ..... A63H 3/06
(52) U.S. Cl. ..... 446/220
(58) Field of Search ..... 446/220, 221, 446/222, 223, 224, 225, 226; D21/440, 445; 40/212, 214; 244/153 A, 153 R, 155 A, 154, 31, 32, 30, 125, 33, 146, 155 R

(56) References Cited

U.S. PATENT DOCUMENTS

| | | | | |
|---|---|---|---|---|
| 4,032,086 A | | 6/1977 | Cooke | |
| 4,038,777 A | | 8/1977 | Schwartz | |
| 4,113,206 A | | 9/1978 | Wheeler | |
| 4,307,537 A | * | 12/1981 | Bergmann | 446/222 |
| 4,309,840 A | * | 1/1982 | Kulesza et al. | 446/224 |
| 4,529,153 A | * | 7/1985 | Conn | 244/126 |
| 4,580,990 A | * | 4/1986 | Avery | 446/46 |
| 4,778,431 A | * | 10/1988 | Dudley | 446/221 |
| 4,894,039 A | * | 1/1990 | Taylor et al. | 446/75 |
| 4,925,426 A | | 5/1990 | Lovik | |
| 5,115,997 A | | 5/1992 | Peterson | |
| 5,115,998 A | | 5/1992 | Olive | |
| 5,169,353 A | * | 12/1992 | Myers | 446/221 |
| 5,194,029 A | * | 3/1993 | Kinoshita | 446/35 |
| 5,334,072 A | | 8/1994 | Epstein | |
| 5,645,248 A | * | 7/1997 | Campbell | 244/30 |
| 5,743,786 A | * | 4/1998 | Lindsey | 446/85 |
| 5,765,831 A | * | 6/1998 | Huffhines | 273/348.4 |
| 5,882,240 A | | 3/1999 | Larsen | |
| 5,893,790 A | * | 4/1999 | Montgomery | 446/220 |
| 5,906,530 A | * | 5/1999 | Lindsey | 446/85 |
| 6,276,984 B1 | | 8/2001 | Komaba | |
| 2001/0003505 A1 | | 6/2001 | Bertrand | |

FOREIGN PATENT DOCUMENTS

| | | | | |
|---|---|---|---|---|
| DE | 4136160 A1 * | 5/1993 | | B64D/17/64 |
| DE | 29609516 U1 * | 8/1996 | | A63H/27/18 |
| JP | 1238890 | 9/1989 | | |

* cited by examiner

*Primary Examiner*—Derris H. Banks
*Assistant Examiner*—Urszula M Cegielnik
(74) *Attorney, Agent, or Firm*—Richard C. Litman

(57) ABSTRACT

The rigid helium balloon has a helium compartment and a separate, channel portion. Helium gas is filled into the helium compartment through a valve in the balloon. Fiberglass rod members are inserted into the channel portion to help retain the desired shape of the balloon. The rod members also provide a counterbalancing weight which prevents the balloon from floating upward. Thus, the balloon, once released into the air, will retain its shape and remain floating at the height from which it was released unless repositioned. No additional weights or tethering devices are required to prevent the balloon from floating upwards.

6 Claims, 3 Drawing Sheets

RIGID HELIUM BALLOONS

BACKGROUND OF THE INVENTION

1. Field of the Invention

The present invention relates to helium balloons, and more particularly, to helium balloons having a rigid skeleton.

2. Description of the Related Art

Generally, it has been difficult to fabricate balloons with continuously curved shapes, and well-defined corners, or edges. Most balloons are formed in spherical shapes in order to allow the greatest volume for the least surface area. Also, the thin material of the balloon naturally becomes spherical as pressure is increased. To achieve the desired non-spherical shape, then, it is necessary to provide a supporting frame to maintain the thin material of the balloon. However, in the past, the weight of such frames, even when the most efficient materials for such purposes were selected, typically required a displaced volume of such size that fabrication for home use or the like would have been impractical. Consequently, helium balloons are typically formed in spherical shapes with some type of tethering device attached for maintaining control of the balloon's elevation.

U.S. Pat. No. 4,032,086, issued Jun. 28, 1977 to W. Cooke, discloses an aerostat or aquastat in which a sealed envelope of flexible material is mounted on a flexible frame which can be caused to expand the envelope after it has been evacuated of internal gas, thereby setting up a vacuum or partial vacuum condition in the envelope. By controlling the frame to adjust the volume of the envelope, the lift or buoyancy of the device can be controlled in flight or precisely determined before ascent.

U.S. Pat. No. 4,038,777, issued Aug. 2, 1977 to S. Schwartz, discloses a gas filled, balloon-like object capable of defining a non-spherical shape. A high modulus graphite-impregnated epoxy material is used to prevent distortion of the inflated object. Strings or weights are required to prevent upward ascent of the balloon.

U.S. Pat. No. 4,113,206, issued Sep. 12, 1978 to D. Wheeler, discloses a lighter-than-air apparatus, including a thin, pliable air-tight outer envelope disposed in overlying relationship over a light-weight, coarse-opening inner frame of a spherelike shape.

Other devices relating to balloons and lighter-than-air apparatuses include U.S. Pat. No. 2001/0003505 A1 issued Jun. 14, 2001 to T. Bertrand, which discloses a lighting apparatus secured to a balloon by string under tension; U.S. Pat. No. 4,925,426 issued May 15, 1990 to C. Lovik, which discloses an open skeletal frame of rigid rod-like formers made of thin strands of plastic, wire, or the like and which permits the insertion of an uninflated balloon of conventional shape and size into the interior thereof so that upon inflation of the balloon, the latex sidewall material of the balloon projects outwardly through the openings of the formers to produce bulbous projections; U.S. Pat. No. 5,115,997 issued May 26, 1992 to J. Peterson, which discloses a tethered surveillance balloon having a relatively low lift-to-weight ratio; U.S. Pat. No. 5,115,998 issued May 26, 1992 to L. Olive, which discloses a double-walled, annular balloon which requires less gas to inflate than its volume would indicate; U.S. Pat. No. 5,334,072, issued Aug. 2, 1994 to M. Epstein, which discloses an inflatable body, such as a balloon, and holder assembly therefore; U.S. Pat. No. 5,882,240, issued Mar. 16, 1999 to B. Larsen, which discloses a toy blimp; U.S. Pat. No. 6,276,984, issued Aug. 21, 2001 to K. Komaba, which discloses a balloon having adhering members disposed upon its surface; Japanese Patent No. 1238890, published Sep. 25, 1989, which discloses plastic film balloons in animal and other complex shapes.

None of the above inventions and patents, taken either singly or in combination, is seen to describe the instant invention as claimed. Thus a rigid helium balloon solving the aforementioned problems is desired.

SUMMARY OF THE INVENTION

The present invention relates to a rigid balloon capable of having a non-spherical shape. The balloon includes a helium compartment and a separate, channel portion. Helium gas is filled into the helium compartment through a valve in the balloon. Fiberglass rod members are inserted into the channel portion to help retain the desired shape of the balloon. The rod members also provide a counterbalancing weight which prevents ascension of the balloon. Thus, the balloon, once released into the air, will retain its shape and remain floating at the height from which it was released unless repositioned. No additional weights or tethering devices are required to prevent the balloon from floating upwards.

Accordingly, it is a principal object of the invention to provide a balloon having a rigid skeleton.

It is another object of the invention to provide a balloon having a non-spherical shape.

It is a further object of the invention to provide a balloon which will float in air at a constant distance from the floor surface without being tethered.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
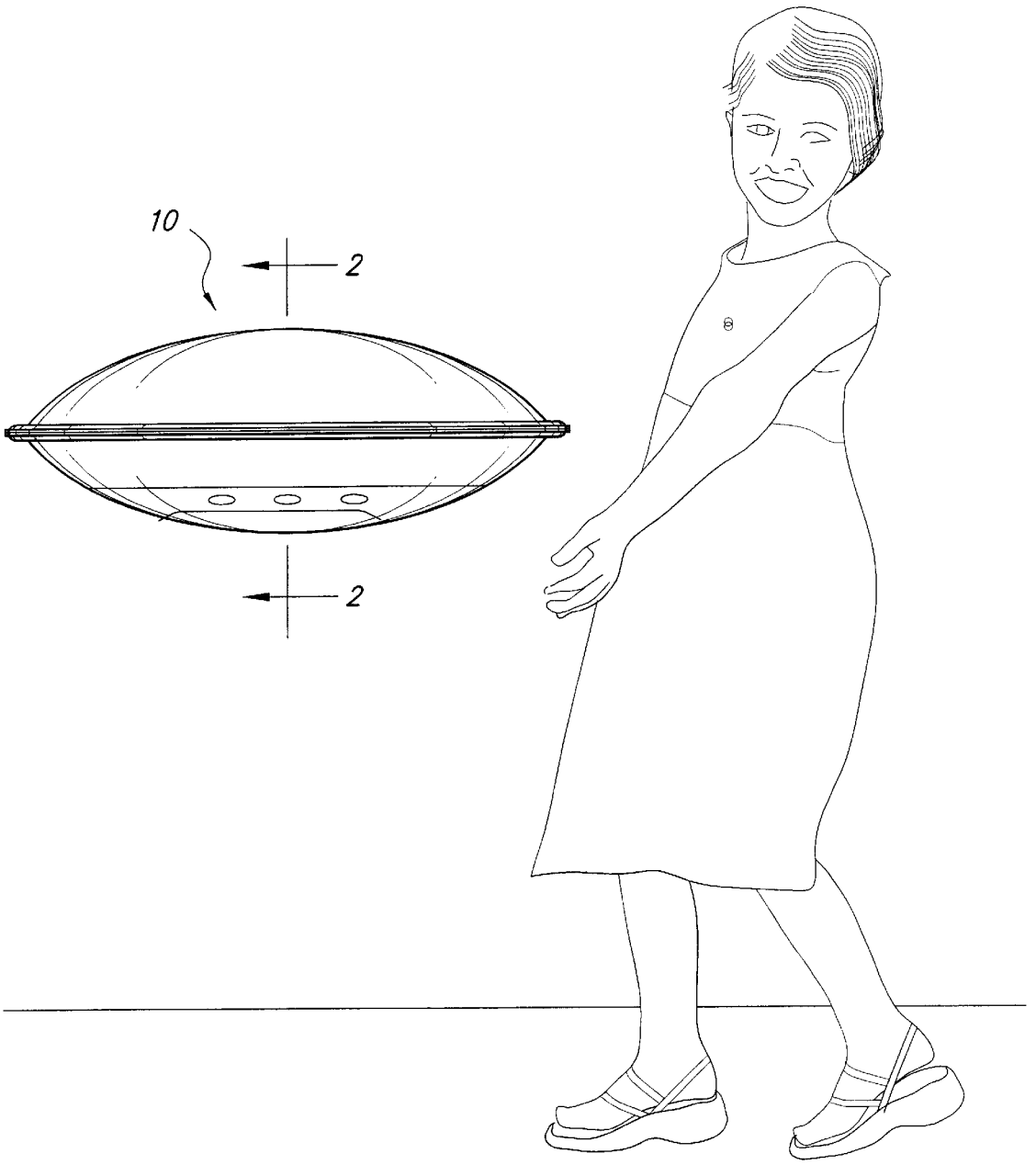
FIG. 1 is an environmental, perspective view of a rigid helium balloon according to the present invention.
Figure 2:
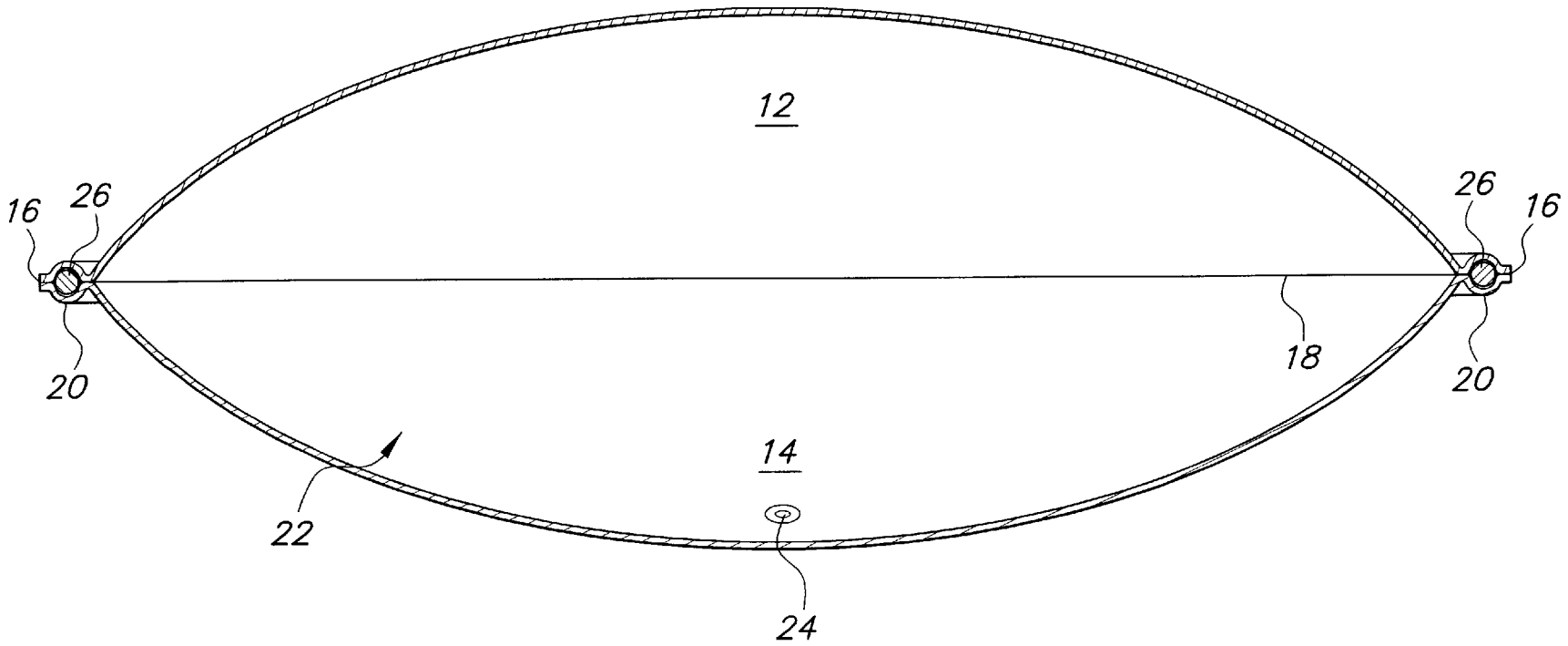
FIG. 2 is a section view along lines 2—2 of FIG. 1.

As shown in FIG. 1, a preferred embodiment of the balloon according to the present invention, generally designated as 10, is relatively small and can be easily adapted as a toy for indoor use. As depicted in FIG. 2, the balloon 10, is made from skin portions 12 and 14, e.g., a top half and a bottom half of the balloon 10. The skin portions 12 and 14 may be formed in any shape desired for the balloon 10. In the embodiment depicted in FIGS. 1–2, the skin portions 12 and 14 are shaped so that when the top half 12 and bottom half 14 are joined, the resulting balloon 10 is a lenticular-shaped balloon which resembles a flying saucer. Skin portions 12 and 14 can be made from any suitable heat sealable material which has low gas permeability. Preferably, however, skin portions 12 and 14 are made from polyethylene terephthalate (sold under the trademark Mylar®, a trademark of E.I. duPont de Nemours & Co. of Wilmington, Del.).

As can be more clearly seen in FIG. 2, the skin portions 12 and 14 are sealed together in a double seam about their periphery, including a first peripheral seam 16 and a parallel or concentric second seam 18. First seam portion 16 and second seam portions 18 are disposed near the peripheral edges of the first and second skins 12 and 14, and are spaced from one another. First seam portion 16 and second seam portion 18 are formed by heat sealing or any other suitable means. A channel portion 20 is defined between seam 16 and seam 18 and extends about the periphery of the balloon 10. Skin portions 12 and 14, when joined, define a helium chamber 22 therebetween. The helium chamber 22 includes a valve 24 through which the balloon 10 may be filled with helium. Preferably the valve 24 is one which is commonly used in Mylar balloons, although any suitable valve may be used.

Figure 3:
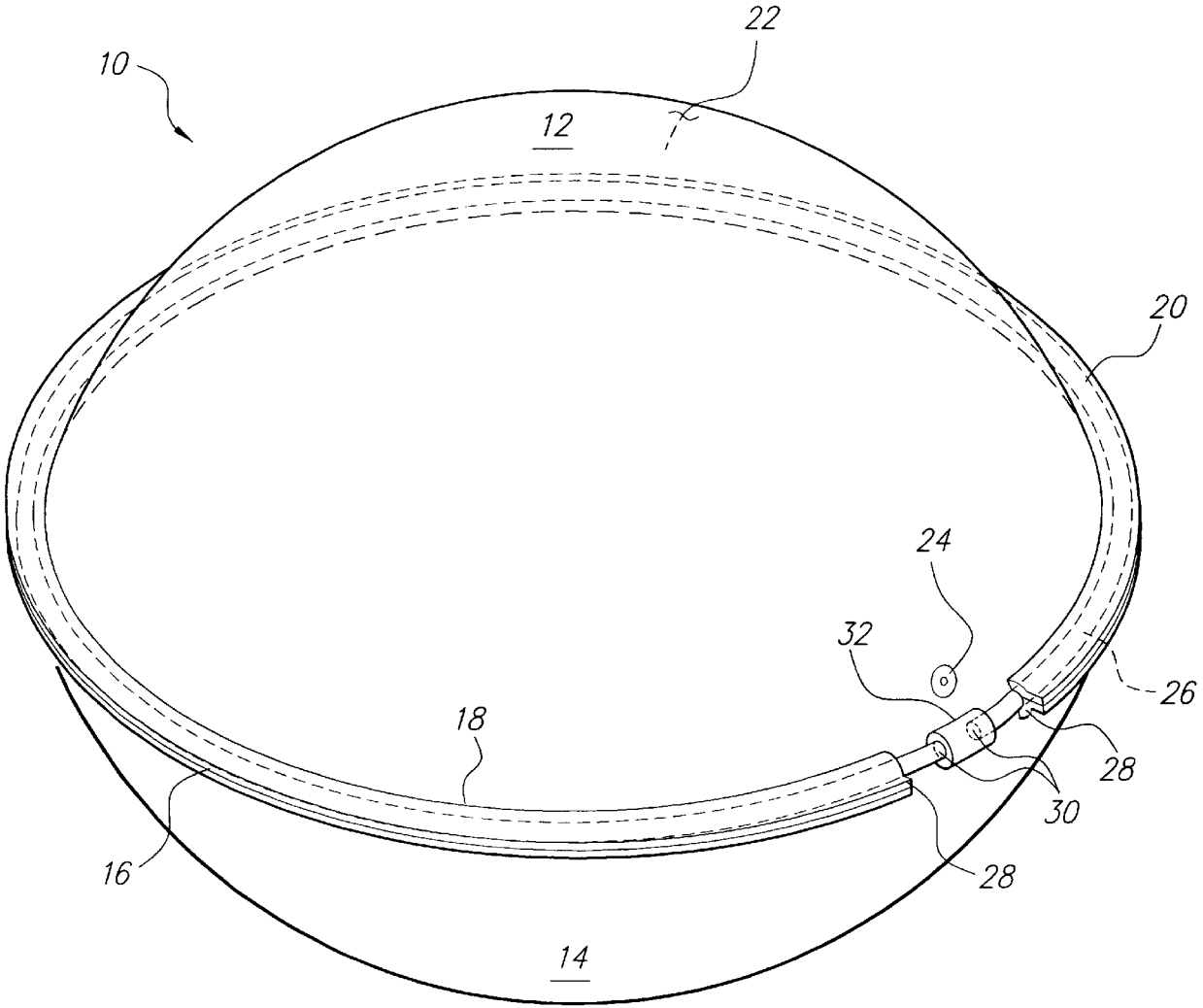
FIG. 3 is a perspective view of a rigid helium balloon according to the present invention.

As can be seen in FIG. 3, at least one rod member 26 is inserted into the channel portion 20 through rod apertures 28. While the rod member 26 can be formed from any acceptable material, it is preferably made from fiberglass. Once the rod member 26 has been inserted through the channel portion 20, opposing ends 30 of the rod member 26 can be joined together by a connector 32 to secure the rod member 26 in place. Any suitable connector 32 may be used to join the ends 30 of the rod member 26. However, a brass fitting having a diameter slightly larger than the diameter of the rod member 26 is preferred. Once the rod member 26 is secured in the channel portion 20, the rod members 26 provide a rigid skeleton for the balloon 10 so that the balloon 10 may maintain its desired shape once it has been inflated with helium. The rod member 26 has a weight which is calculated to counterbalance the buoyant effect of helium so that the balloon 10 is prevented from floating upwards when filled, the balloon 10 simply floating at the height at which it is released.

Although only one rod member 26 is depicted in the drawings, for some shapes, it may be necessary to use a plurality of rod members 26 of varying sizes (not shown). For such shapes, for example those with a plurality of curves or angles, a plurality of rod apertures are provided at various points on the balloon 10 so that the rod members 26 may be easily inserted into the channel portion 20. The rod members 26 can then be connected to one another using the connector 32, as previously described.

It is to be understood that the present invention is not limited to the embodiments described above, but encompasses any and all embodiments within the scope of the following claims.

I claim:

1. A rigid helium balloon comprising:

a first skin portion;

a second skin portion joined to said first skin at a double seam about their periphery, the double seam defining a channel extending about the periphery of the first and second skin portions;

a helium compartment disposed between said first and second portions;

at least one rod member disposed within said channel portion, said rod member having opposing ends; and at least one connector secured to at least one of said opposing rod ends to hold said rod member in said channel portion.

2. The balloon of claim 1, further comprising a valve extending into the helium compartment through which helium gas may be inserted.

3. The balloon of claim 1, wherein said first and second skin members are made from polyethylene terephthalate.

4. The balloon of claim 1, wherein said at least one rod member is made from fiberglass.

5. The balloon of claim 1, wherein said connector is a brass fitting.

6. A rigid helium balloon comprising:

a first skin member;

a second skin member joined to said first skin member at a first peripheral seam and at a second peripheral seam, said second peripheral seam being spaced from said first peripheral seam;

a helium compartment disposed between said first and second skin members;

a channel portion defined between said first peripheral seam and said second peripheral seam, said channel portion having at least two rod apertures;

at least one fiberglass rod member disposed within said channel portion, said rod member having opposing ends; and a connector secured to at least one of said opposing rod ends;

wherein said first and second skin portions are made from polyethylene terephthalate.

* * * * *